US009474108B2

(12) United States Patent
Hann et al.

(10) Patent No.: US 9,474,108 B2
(45) Date of Patent: Oct. 18, 2016

(54) HYDROCARBON RESOURCE PROCESSING APPARATUS FOR GENERATING A TURBULENT FLOW OF COOLING LIQUID AND RELATED METHODS

(71) Applicant: HARRIS CORPORATION, Melbourne, FL (US)

(72) Inventors: Murray Hann, Malabar, FL (US); Mark Alan Trautman, Melbourne, FL (US); John E. White, Melbourne, FL (US); Brian Wright, Indialantic, FL (US)

(73) Assignee: HARRIS CORPORATION, Melbourne, FL (US)

( * ) Notice: Subject to any disclaimer, the term of this patent is extended or adjusted under 35 U.S.C. 154(b) by 622 days.

(21) Appl. No.: 14/021,119

(22) Filed: Sep. 9, 2013

(65) Prior Publication Data

US 2015/0068706 A1 Mar. 12, 2015

(51) Int. Cl.

| | |
|---|---|
| ***E21B 36/04*** | (2006.01) |
| ***H05B 6/00*** | (2006.01) |
| ***E21B 43/24*** | (2006.01) |

(52) U.S. Cl.

CPC ..... *H05B 6/00* (2013.01); *E21B 43/2408* (2013.01)

(58) Field of Classification Search

CPC .. E21B 43/2401; E21B 36/04; E21B 36/001; H05B 2214/03

See application file for complete search history.

(56) References Cited

U.S. PATENT DOCUMENTS

| | | | | |
|---|---|---|---|---|
| 4,398,597 | A * | 8/1983 | Haberman | E21B 36/04 166/248 |
| 5,829,519 | A | 11/1998 | Uthe | |
| 7,441,597 | B2 | 10/2008 | Kasevich | |
| 7,770,602 | B2 | 8/2010 | Buschhoff | |
| 7,891,421 | B2 | 2/2011 | Kasevich | |
| 2005/0103497 | A1 | 5/2005 | Gondouin | |
| 2005/0217859 | A1 * | 10/2005 | Hartman | E21B 43/38 166/369 |
| 2007/0137575 | A1 * | 6/2007 | Ohmi | C23C 16/4411 118/723 MW |
| 2008/0265654 | A1 | 10/2008 | Kearl et al. | |
| 2009/0022905 | A1 | 1/2009 | Kudela et al. | |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2012/0061383 | A1 | 3/2012 | Parsche | |

FOREIGN PATENT DOCUMENTS

| | | |
|---|---|---|
| CA | 2790618 | 8/2011 |

OTHER PUBLICATIONS

Wikipedia page for Nusselt Number.*
Wikipedia page for Graetz number.*

* cited by examiner

*Primary Examiner* — Kipp Wallace
(74) *Attorney, Agent, or Firm* — Allen, Dyer, Doppelt, Milbrath & Gilchrist, P.A.

(57) ABSTRACT

A device for processing hydrocarbon resources in a subterranean formation may include a radio frequency (RF) source, a dielectric cooling liquid source, and an RF applicator in the subterranean formation and coupled to the RF source to supply RF power to the hydrocarbon resources. The RF applicator may include concentric tubular conductors defining cooling passageways therebetween coupled to the dielectric cooling fluid source. At least one property of the dielectric cooling liquid, a flow rate of the dielectric cooling liquid, and a configuration of the cooling passageways may be operable together to generate a turbulent flow of the dielectric cooling liquid adjacent surfaces of the plurality of concentric tubular conductors to enhance thermal transfer.

18 Claims, 7 Drawing Sheets

HYDROCARBON RESOURCE PROCESSING APPARATUS FOR GENERATING A TURBULENT FLOW OF COOLING LIQUID AND RELATED METHODS

FIELD OF THE INVENTION

The present invention relates to the field of radio frequency (RF) equipment, and, more particularly, to an apparatus for processing hydrocarbon resources using RF heating and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale.

Increased power applied within the subterranean formation may result in antenna component heating. One factor that may contribute to the increased heating may be the length of the coaxial transmission line, for example. Component heating for the antenna may be undesirable, and may result in less efficient hydrocarbon resource recovery, for example.

A typical coaxial feed geometry may not allow for adequate flow of a cooling fluid based upon a relatively large difference in hydraulic volume between inner and outer conductors of the coaxial feed. More particularly, a typical coaxial feed may be assembled by bolted flanges with compressed face seals, for example. The coaxial feed also includes a small inner conductor with a standoff for the signal voltage. However, the typical coaxial feed may not be developed for use with a coolant and for increased thermal performance. Moreover, hydraulic volumes of the inner and outer conductors may be significantly different, which may affect overall thermal performance.

To more efficiently recover hydrocarbon resources, it may be desirable to inject a solvent, for example, in the subterranean formation. For example, the solvent may increase the effects of the RF antenna on the hydrocarbon resources. One approach for injecting a solvent within the subterranean formation includes the use of sidetrack wells that are typically used for instruction and are separate from the tubular conductors used for hydrocarbon resource recovery.

U.S. Patent Application Publication No. 2005/0103497 to Gondouin discloses a down-hole flow control apparatus, super-insulated tubular, and surface tools for producing heavy oil by steam injection. More particularly, Gondouin discloses using two dedicated and super-insulated vertical tubulars, coaxially carrying wet steam at the center, surrounded by heated oil through the coldest part of their environment.

U.S. Pat. No. 7,770,602 to Buschhoff discloses a double wall pipe. More particularly, Buschhoff discloses a double wall pipe with an inner high pressure pipe having an inner flow space for liquids. The double wall pipe also includes an outer protection pipe coaxially arranged around the inner pipe. The outer pipe has longitudinal grooves on an inner surface. The inner high pressure pipe is fitted tightly into the outer protection pipe.

It may thus be desirable to provide increased efficiency hydrocarbon resource recovery. More particularly, it may be desirable to provide increased cooling and/or coolant liquid injection along with an RF antenna.

SUMMARY OF THE INVENTION

In view of the foregoing background, it is therefore an object of the present invention to provide a hydrocarbon resource processing apparatus that provides increased heat removal.

This and other objects, features, and advantages in accordance with the present invention are provided by an apparatus for processing hydrocarbon resources in a subterranean formation that includes a radio frequency (RF) source, a dielectric cooling liquid source, and an RF applicator in the subterranean formation and coupled to the RF source to supply RF power to the hydrocarbon resources. The RF applicator includes a plurality of concentric tubular conductors defining cooling passageways therebetween coupled to the dielectric cooling fluid source. At least one property of the dielectric cooling liquid, a flow rate of the dielectric cooling liquid, and a configuration of the cooling passageways cooperate to generate a turbulent flow of the dielectric cooling liquid adjacent surfaces of the plurality of concentric tubular conductors to thereby enhance thermal transfer.

The at least one property of the dielectric cooling liquid may include a density and a viscosity. The dielectric cooling liquid source may include a dielectric cooling liquid supply and a heat exchanger. The dielectric cooling liquid may include mineral oil, for example.

A method aspect is directed to a method of processing hydrocarbon resources in a subterranean formation using an apparatus that includes a radio frequency (RF) source, a dielectric cooling liquid source, an RF applicator in the subterranean formation and coupled to the RF source to supply RF power to the hydrocarbon resources, and a plurality of concentric tubular conductors defining cooling passageways therebetween coupled to the dielectric cooling fluid source. The method includes generating a turbulent flow of the dielectric cooling liquid adjacent surfaces of the plurality of concentric tubular conductors to thereby enhance thermal transfer by at least configuring at least one property of the dielectric cooling liquid, configuring a flow rate of the dielectric cooling liquid, and configuring the cooling passageways.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
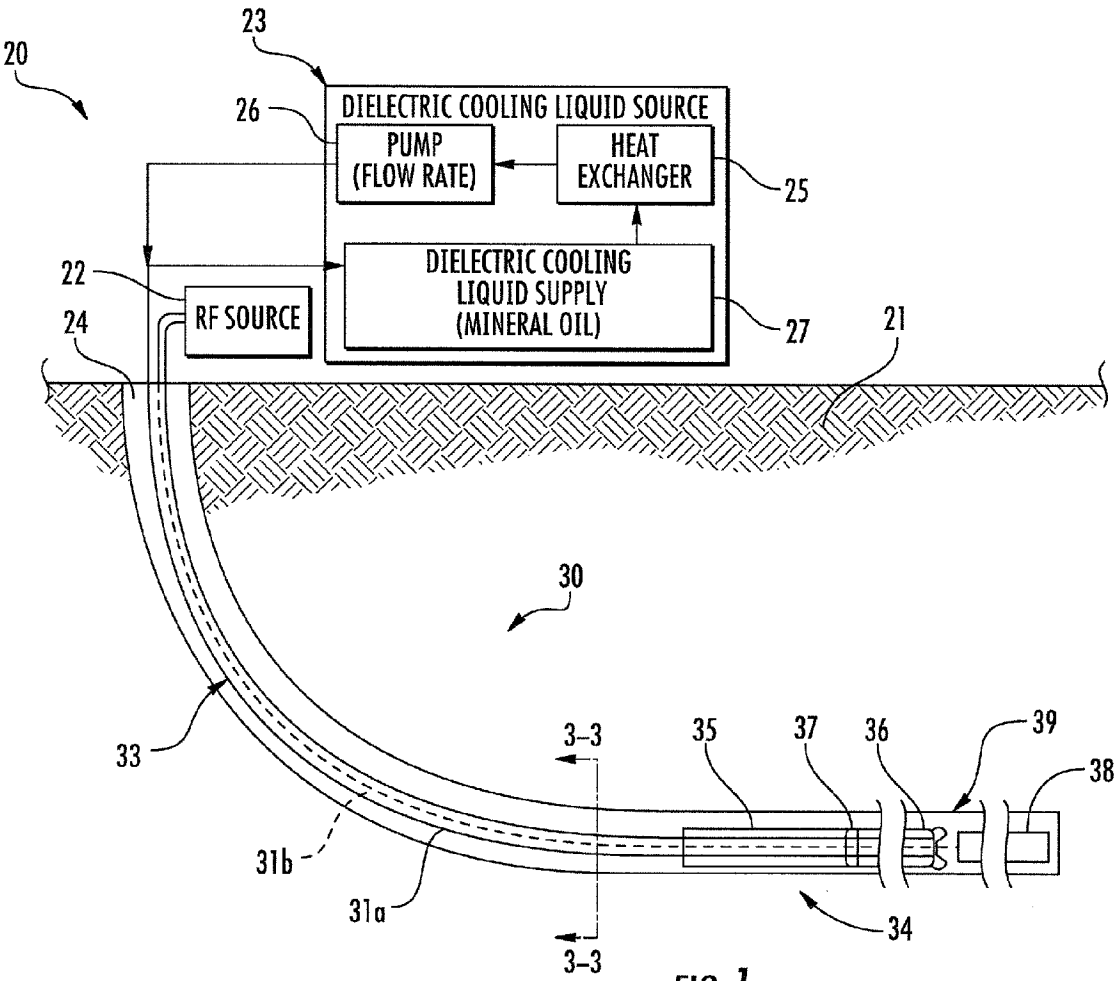
FIG. 1 is a schematic diagram of a subterranean formation including an apparatus for processing hydrocarbon resources in accordance with the present invention.

Referring initially to FIG. 1, an apparatus 20 for processing hydrocarbon resources in a subterranean formation 21 is described. The subterranean formation 21 includes a wellbore 24 therein. The wellbore 24 illustratively extends laterally within the subterranean formation 21. In some embodiments, the wellbore 24 may be a vertically extending wellbore, for example, and may extend vertically in the subterranean formation 21. Although not shown, in some embodiments a second or producing wellbore may be used below the wellbore 24, such as would be found in a SAGD implementation, for collection of petroleum, etc., released from the subterranean formation 21 through heating. The apparatus 20 also includes a radio frequency (RF) source 22.

Figure 2:
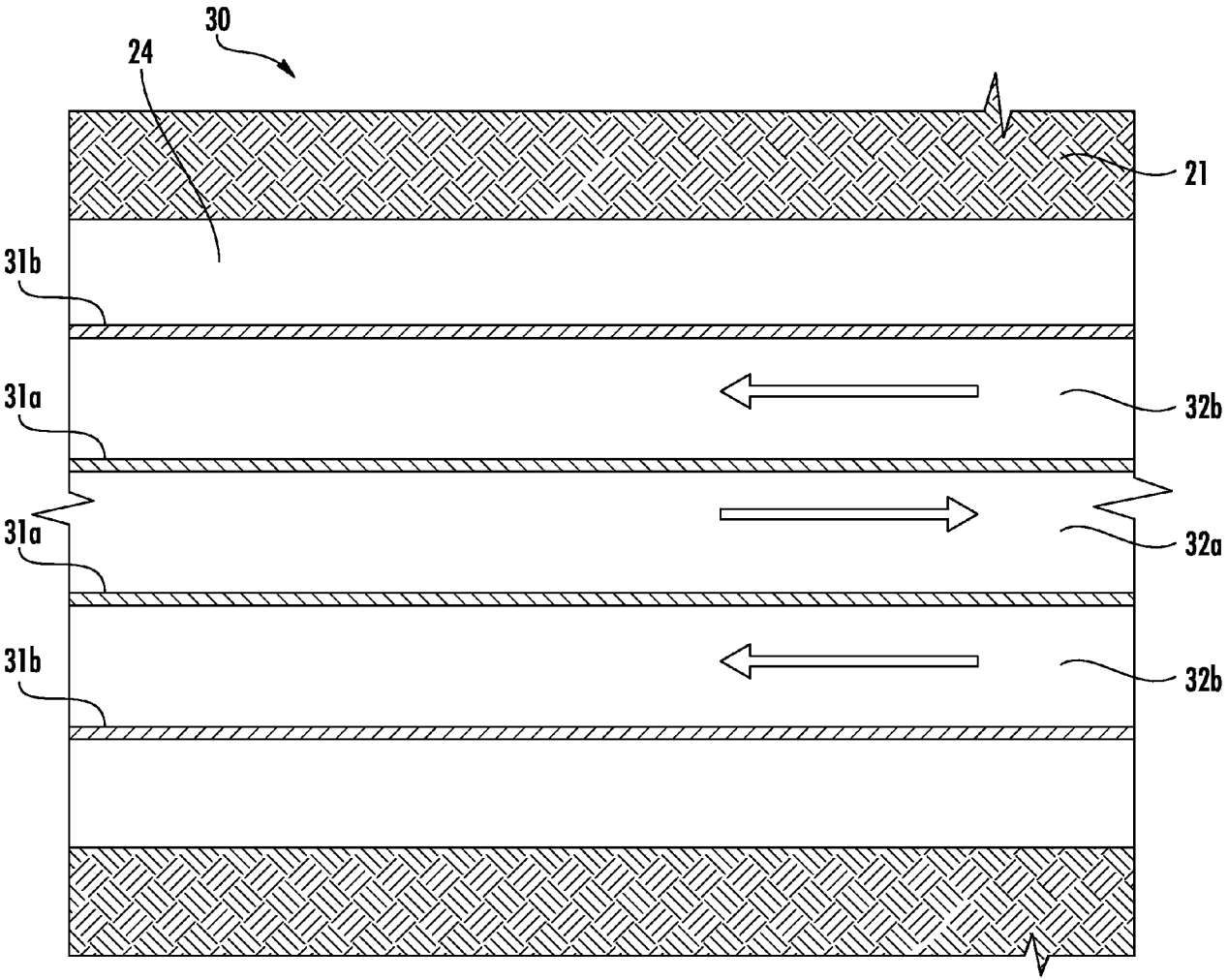
FIG. 2 is a schematic longitudinal cross-sectional view of a portion of the RF applicator of the apparatus of FIG. 1.
Figure 3:
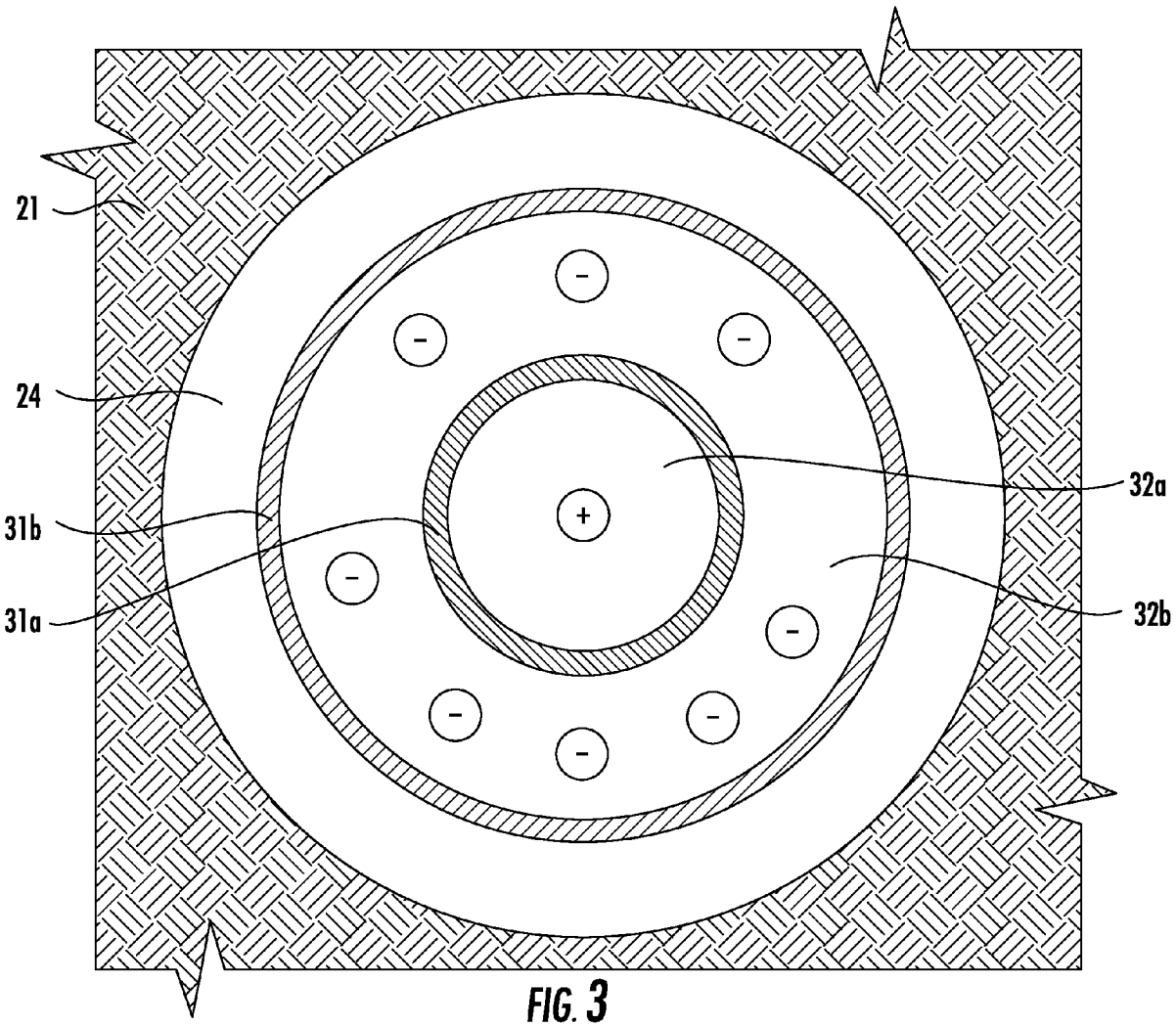
FIG. 3 is a schematic cross-sectional view of a portion of the RF applicator taken along line 3-3 of the apparatus of FIG. 1.

Referring now additionally to FIGS. 2 and 3, an RF applicator 30 is in the subterranean formation 21 and coupled to the RF source 22 to supply RF power to and heat the hydrocarbon resources. The RF applicator 30 includes two concentric tubular conductors 31*a*, 31*b*. The two concentric tubular conductors 31*a*, 31*b* define cooling passageways 32*a*, 32*b* therebetween. The cooling passageways 32*a*, 32*b* are coupled to a dielectric cooling liquid source 23. It should be noted that the "+" symbol indicates a liquid flow out of the page, while "–" symbols indicate a liquid flow into the page. (FIG. 3) The concentric tubular conductors 31*a*, 31*b* extend laterally within the subterranean formation 21. Of course, in some embodiments, the tubular conductors 31*a*, 31*b* may extend entirely vertically, entirely horizontally, or extend at a slant in any direction. Moreover, while two concentric tubular conductors 31*a*, 31*b* are illustrated, the RF applicator 30 may include more than two concentric tubular conductors, for example, as will be described in further detail below. Exemplary diameters of the first and second (inner and outer) concentric tubular conductors 31*a*, 31*b* are 43 mm and 81 mm respectively. Of course, the concentric tubular conductors 31*a*, 31*b* may be other sizes.

The RF applicator 30 includes an RF transmission line 33 in the form of an RF coaxial transmission line. One of the concentric tubular conductors 31*a* advantageously defines the inner conductor of the RF coaxial transmission line 33, and the other of the concentric tubular conductors 31*b* defines the outer conductor of the RF coaxial transmission line.

Heating of the hydrocarbon resources within the subterranean formation 21 involves the use of relatively high voltages, for example, several kilovolts to tens of kilovolts. In some examples, supplied RF power may be up to 10 kW/m, have a relatively low associated power loss, for example less than 5%, and have a typical dissipation at 5 kW/m of about 100 W/m. Operation of a coaxial RF transmission line 33 at a temperature of less than 150° C., and, more particularly, 100° C. is desirable for increasingly reliable operation. Limited use of seals, spacers, and fluids may provide some cooling. However, this may not be sufficient for desired cooling.

Referring particularly to FIG. 1, the RF applicator 30 also includes an RF antenna 34, and more particularly, an RF dipole antenna coupled to a distal end of the RF coaxial transmission line 33. A first electrically conductive sleeve 35 surrounds and is spaced apart from the RF coaxial transmission line 33 defining a balun, for example, a sleeve balun. A second electrically conductive sleeve 36 surrounds and is spaced apart from the coaxial RF transmission line 33. The concentric tubular conductor 31*b* defining the outer conductor of the RF coaxial transmission line is coupled to the second electrically conductive sleeve 36 at a distal end of the RF coaxial transmission line 33 defining a leg of the RF dipole antenna 34 (i.e., the ground side). The second electrically conductive sleeve 36 is spaced from the first electrically conductive sleeve 35 by a dielectric tubular spacer 37 (i.e., an isolator). A third electrically conductive sleeve 38 is coupled to the concentric tubular conductor 31*a* defining another leg of the RF dipole antenna 34 (i.e., the hot side).

The third electrically conductive sleeve 38 should generally be electrically isolated from the second electrically conductive sleeve 36. For ordinary wire dipoles in air, this may be accomplished by space or spacing, for example, air space, between the legs of the RF dipole antenna 34, or two dipole halves. However, for an installation, for example, as described herein, wherein the two legs of RF dipole antenna 34, or dipole halves, are to be mechanically connected for purposes of deployment in the wellbore 24, the two dipole halves may be separated by an isolator, for example, similar to dielectric tubular spacer 37 described herein.

Of course, while an RF dipole antenna is described herein, it will be appreciated that other types of RF antennas may be used, and may be configured with the RF transmission line in other arrangements. Additionally, while a balun, and more specifically a quarter wave balun, has been described, it will be appreciated that other elements, for example, a choke, such as a magnetic choke balun, may be alternatively or additionally used.

A startup temperature near the RF dipole antenna 34 may reach up to 260° C., and in-situ hydrocarbon recovery processes may reach temperatures of up to 700° C. Corrosive materials, such as, for example, steam, $H_2S$, and salts, may be also be present within the wellbore 24. With particular respect to the RF dipole antenna 34, there is a relatively high field intensity near the antenna during the supplying of RF power. Spacing and/or insulating materials may limit the temperature adjacent isolator sections, for example. However, a temperature of less than 200° C., and more preferably, less than 150° C. is desirable. Thus, it may be particularly desirable to provide additional or increased cooling, especially if a casing if used. While a solvent in the form of a liquid or vapor and adjacent the RF dipole antenna 34 may be used to provide cooling, the solvent is typically superheated, for example, having a temperature of greater than 60° C. for propane dependent on local pressure conditions. Additional cooling may be desired.

The dielectric cooling liquid source 23 includes a dielectric cooling liquid supply 27 and a heat exchanger 25. The dielectric cooling liquid source 23 also includes a pump 26 coupled to the dielectric cooling liquid supply 27 and the heat exchanger 25. In particular, as the dielectric cooling liquid, which may be mineral oil, for example, is circulated by way of the pump 26 through the cooling passageways 32*a*, 32*b*, heat generated from the RF power may be dissipated within the dielectric cooling, for example, depending on the fluid used for a given implementation. The heat exchanger 25 removes heat from the dielectric cooling liquid as it flows from the subterranean formation 21. Thus, a reduced temperature dielectric liquid e.g., mineral oil, may remove heat from the RF transmission line 33 while RF power is being applied to the hydrocarbon resources. Other types of dielectric cooling liquids may be circulated, for example, a solvent, which may be delivered downhole via the cooling passageways 32*a*, 32*b*. Of course, other devices or parts of the RF applicator 30 may be cooled by dielectric cooling liquid.

At least one property of the dielectric cooling liquid, a flow rate of the dielectric cooling liquid, and a configuration of the cooling passageways cooperate to generate a turbulent flow of the dielectric cooling liquid adjacent surfaces of the concentric tubular conductors 31*a*, 31*b*. For example, the properties of the dielectric cooling liquid that may cooperate may include a density and a viscosity. A turbulent flow enhances thermal transfer. In other words, the turbulent flow removes an increased amount of heat from adjacent the surfaces of the concentric tubular conductors 31*a*, 31*b*. Of course, generating a turbulent flow may be particularly useful for other devices or elements part of or associated with the RF applicator, which may or may not be within the wellbore 24.

The turbulent flow may have a Reynolds number greater than 2500, for example. A Reynolds number is defined where a fluid is in relative motion to a surface and typically is based upon the fluid, i.e., dielectric cooling liquid, properties of density and viscosity, plus a velocity and a characteristic length or characteristic dimension. A Reynolds number Re may be defined as follows:

$$Re = \frac{\rho v L}{\mu} = \frac{vL}{\upsilon}$$

where:

v is the mean velocity of the object relative to the fluid (m/s);

L is a characteristic linear dimension, (travelled length of the fluid (m);

μ is the dynamic viscosity of the fluid (Pa·s or N·s/m$^2$ or kg/(m·s));

ν is the kinematic viscosity (m$^2$/s); and

ρ is the density of the fluid (kg/m$^3$).

For the flow in the concentric tubular conductors 31*a*, 31*b*, the Reynolds number is generally defined as:

$$Re = \frac{\rho v D_H}{\mu} = \frac{v D_H}{\upsilon} = \frac{Q D_H}{\upsilon A}$$

where:

$D_H$ is the hydraulic diameter of the pipe, its characteristic length (m);

Q is the volumetric flow rate (m3/s);

A is the pipe cross-sectional area ($m^2$);

v is the mean velocity of the object relative to the fluid (m/s);

μ is the dynamic viscosity of the fluid (Pa·s or $N \cdot s/m^2$ or kg/(m·s));

ν is the kinematic viscosity ($m^2/s$); and

ρ is the density of the fluid ($kg/m^3$).

In the present embodiment, in particularly, for the annular or concentric tubular conductors 31*a*, 31*b*, the hydraulic diameter can be shown algebraically to reduce to $$D_{H,annulus} = D_0 - D_i$$

Where:

$D_0$ is the inside diameter of the outer tubular conductor 31*b*; and $D_i$ is the outside diameter of the inner tubular conductor 31*a*.

The turbulent flow provides an increased diametral temperature change for practical lengths and heat loading. For relatively long lengths, a practical inlet to outlet temperature delta tends to drive the desired flow. A relatively small diametral temperature variation may increase the reliability of controlling, via measurement, the inlet and outlet temperatures.

Figure 4:
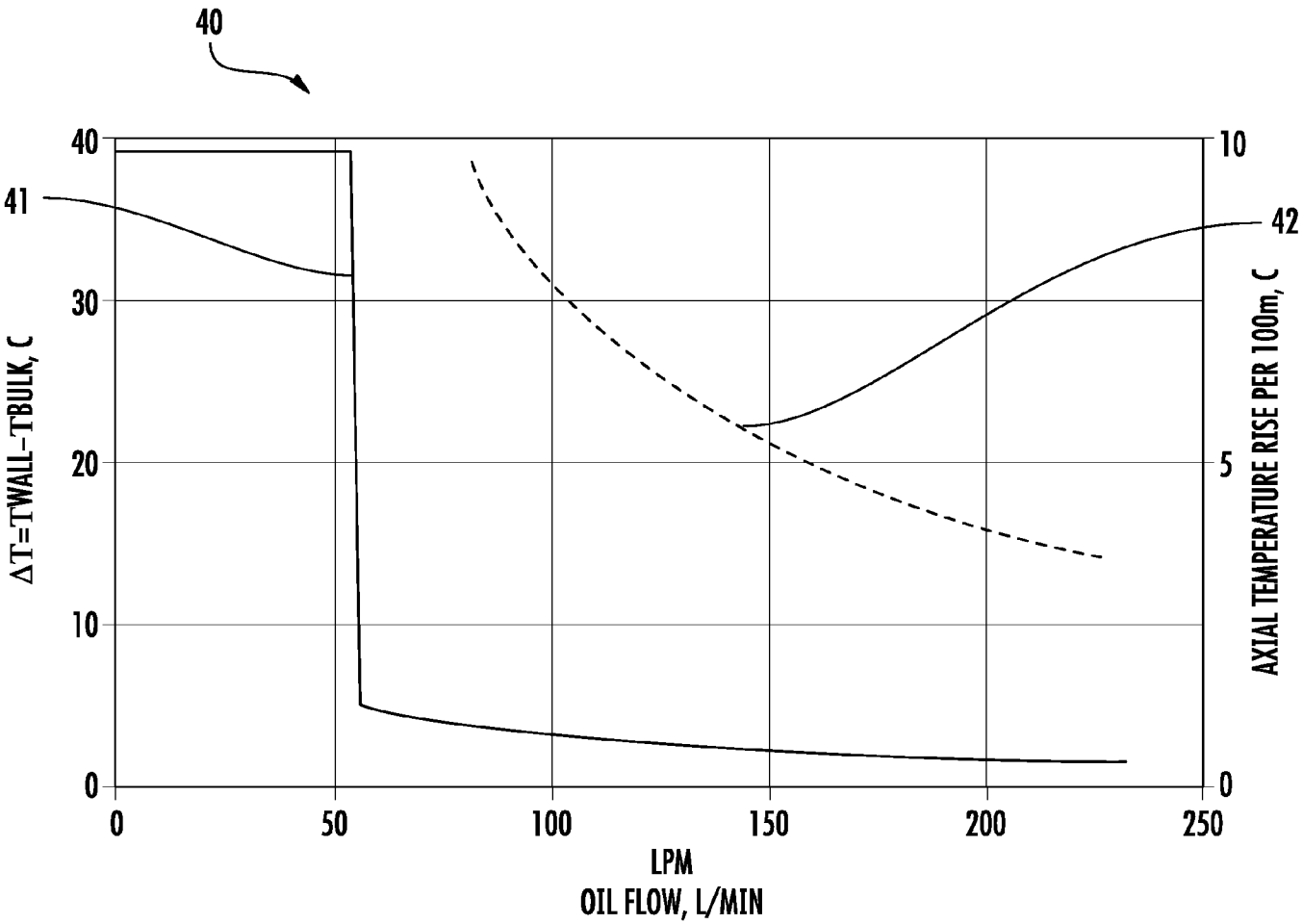
FIG. 4 is a flow versus temperature graph illustrating a turbulent flow and heat transfer from a surface.

Referring to the graph 40 in FIG. 4, the change in temperature for a 38 mm mineral oil passageway with a 250 W/m heat load is illustrated. The line 41 illustrates ΔTd, while the line 42 illustrates ΔTx. As illustrated, the flow changes from a laminar flow to a turbulent flow at about 55 LPM.

Figure 5:
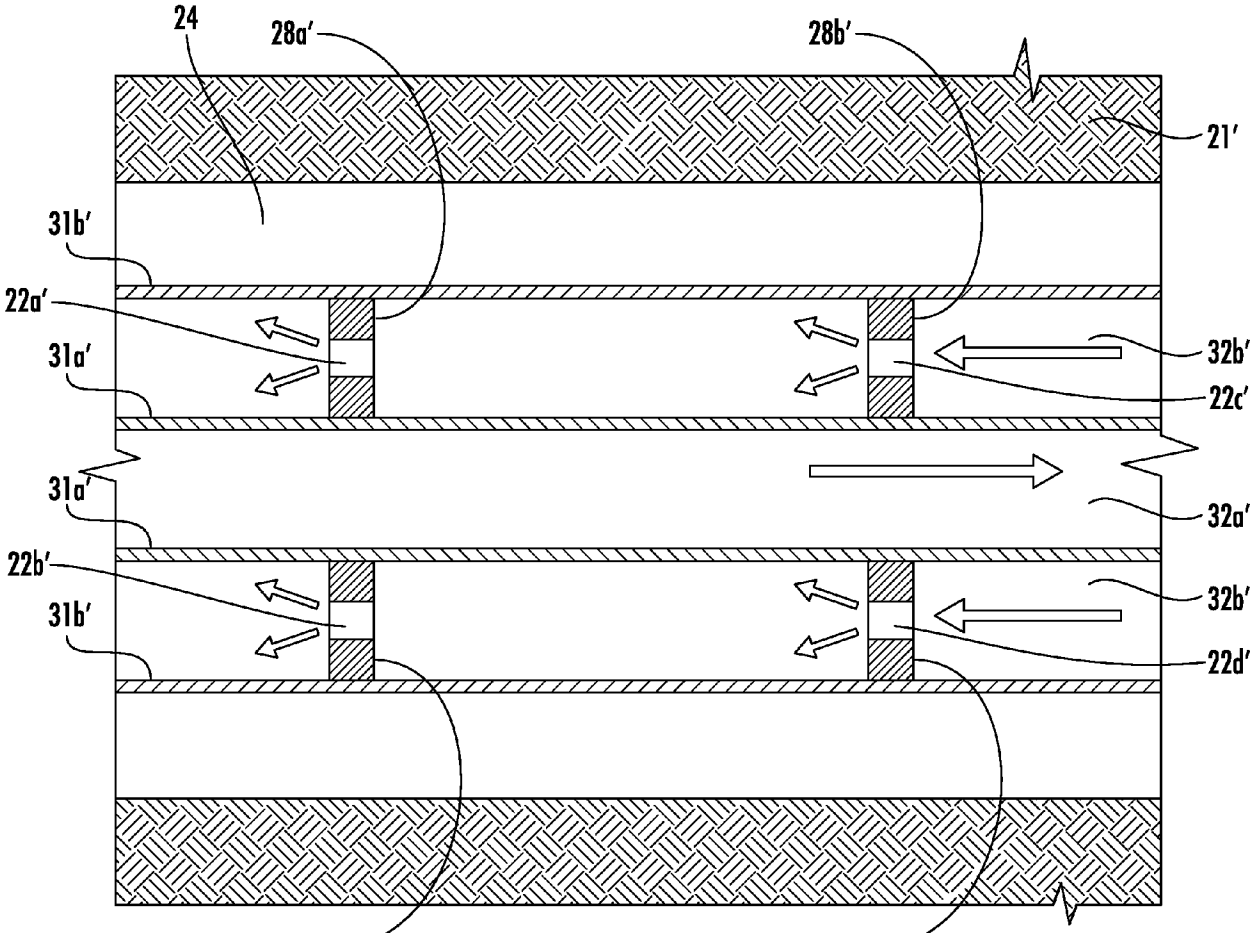
FIG. 5 is a schematic longitudinal cross-sectional view of a portion of an RF applicator in accordance with another embodiment of the present invention.

Referring now to FIG. 5, in another embodiment, the apparatus 20' further includes a series of dielectric spacers 28*a*', 28*b*' between the concentric tubular conductors 31*a*', 32*b*'. Each of the dielectric spacers 28*a*', 28*b*' has openings 22*a*'-22*d*' therein in fluid communication with the cooling liquid passageways 32*a*', 32*b*'. The dielectric spacers define a flow having an inverse Graetz number less than 0.05, for example. Further details of spacers and couplers having openings therein aligned with liquid passageways are described in U.S. application Ser. No. 13/568,452 filed Aug. 7, 2012, assigned to the present assignee and the entire contents of which are herein incorporated by reference. Moreover, while the dielectric spacers 28*a*', 28*b*' are illustratively between the concentric tubular conductors 31*a*', 32*b*', it will be appreciated that the dielectric spacers may be between any concentric tubular conductors for which generation of a turbulent flow is desired, and irrespective of a direction of the liquid flow.

The Graetz number, is a dimensionless number that characterizes laminar flow in a conduit. The Graetz number is defined as:

$$Gz = \frac{D_H}{L} RePr$$

where:

$D_H$ is the diameter or hydraulic diameter;

L is the length;

Re is the Reynolds number; and

Pr is the Prandtl number.

The Graetz number is particularly useful in determining the thermally developing flow entrance length in liquid passageways. For example, a Graetz number of approximately 1000 or less (inverse Graetz number of greater than 0.001) is the point at which a flow would be considered thermally fully developed.

Figure 6:
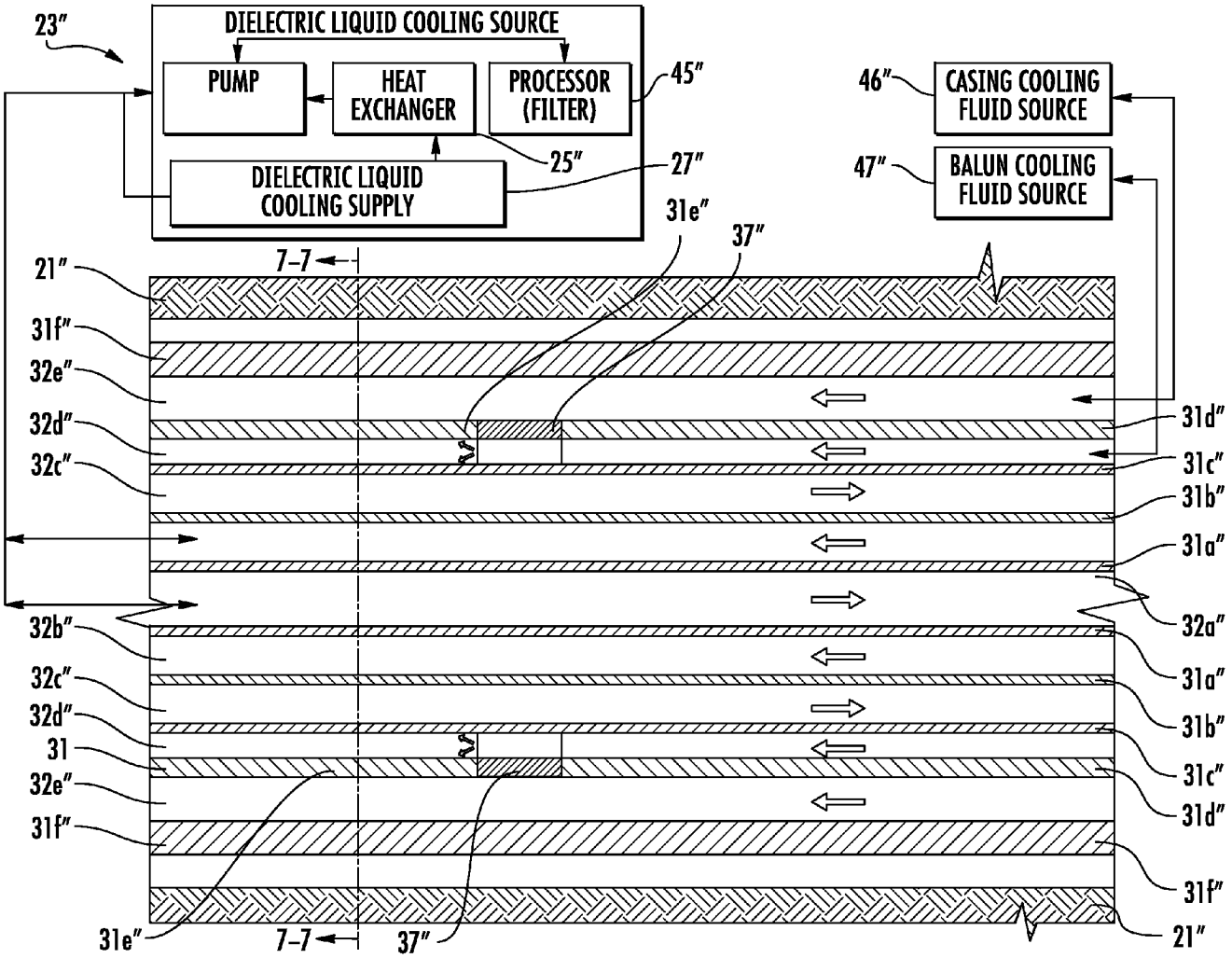
FIG. 6 is a schematic longitudinal cross-sectional view of a portion of an RF applicator in accordance with another embodiment of the present invention.
Figure 7:
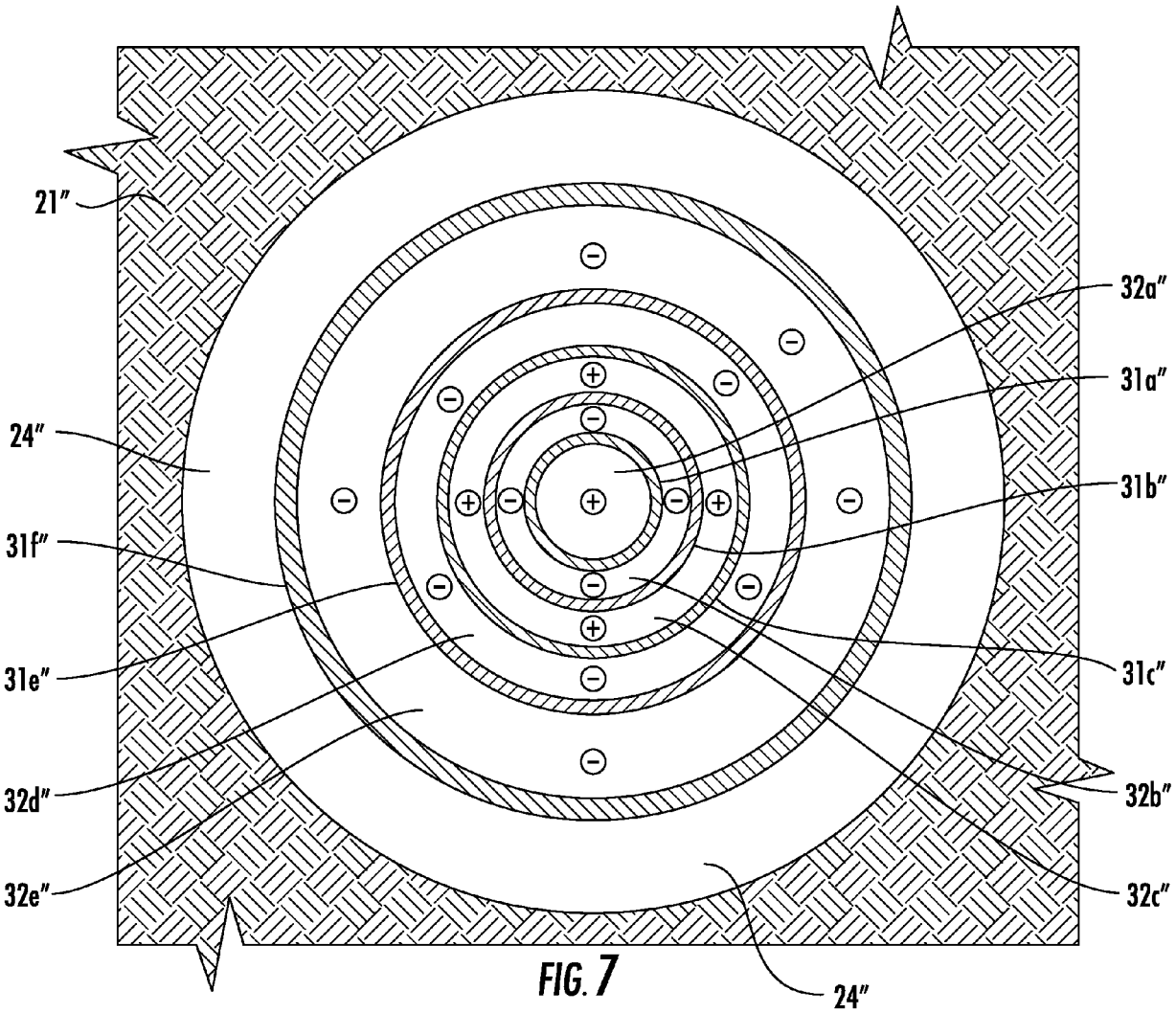
FIG. 7 is a schematic cross-sectional view of a portion of the RF applicator taken along line 7-7 of the apparatus of FIG. 6.

Referring now to FIGS. 6 and 7, in another embodiment, the RF applicator 30" includes five (5) tubular conductors defining five (5) cooling passageways. An inner coaxial conductor of the RF transmission line in the form of a hollow tubular conductor 31*a*" defines a first cooling passageway 32*a*" (inner bore). It should be noted that "+" symbols indicates a liquid flow out of the page, while "–" symbols indicate a liquid flow into the page. (FIG. 7) An outer coaxial conductor of the RF transmission line in the form of a hollow tubular conductor 31*b*" surrounds and is spaced apart from the inner coaxial conductor 31*a*". The outer coaxial conductor 31*b*" together with the inner coaxial conductor 31*a*" define a second cooling passageway 32*b*" (first coaxial annulus).

A third coaxial tubular conductor 31*c*" surrounds and is spaced from the outer conductor 31*b*" and defines a third cooling passageway 32*c*" (second coaxial annulus). An RF dipole antenna element 31*d*" in the form of tubular conductor surrounds and is spaced apart from the third coaxial tubular conductor 31*c*".

A balun tube 31*e*" also in the form of a tubular conductor surrounds and is spaced apart from the third coaxial tubular conductor 31*c*". A tubular dielectric spacer 37*c*" is between the balun tube 31*e*" and the RF dipole antenna element 31*d*" so that, together, the tubular dielectric spacer, the balun tube and the RF dipole antenna element define a fourth cooling passageway 32*d*" (coaxial-balun annulus). A tubular casing 31*f*" surrounds and is spaced apart from the tubular dielectric spacer 37", the balun tube 31*e*" and the RF dipole antenna element 31*d*" and defines a fifth cooling passageway 32*e*" (tube-casing annulus).

Each of the cooling passageways 31*a*"-31*e*" may have a different cooling fluid flowing therethrough. In one embodiment, above the subterranean formation, the apparatus 20" includes a dielectric cooling liquid source 23". The dielectric cooling liquid source 23" includes a dielectric cooling liquid supply 27" for the RF applicator, a heat exchanger 25", and a pump 27" coupled to dielectric cooling liquid supply and the heat exchanger. A dielectric cooling liquid processor 45" is also coupled to the pump and may filter, desiccate, and/or purify the dielectric cooling liquid. An optional solvent supply may also be coupled to one or more of the cooling passageways 32*a*"-32*e*". A casing cooling fluid source 46" and a balun cooling fluid source 47" may also be coupled to respective cooling passageways, for example, the fifth and fourth cooling passageways 32*e*", 32*d*", respectively. The casing cooling liquid source 46" and balun cooling liquid source 47" each may include a respective liquid supply, a pump, and a heat exchanger similar to the dielectric cooling liquid source 23". Of course, other liquids and/or liquid configurations may be used. Moreover, the liquids may be pressurized at a pressure greater than the ambient pressure to reduce contaminant intrusion, for example.

The dielectric cooling liquid may provide increased cooling and reduce high voltage breakdown. Balun fluids also reduce high voltage breakdown, provide an increased heat transfer path, and may provide remote tuning and relatively low circulation for contamination removal. The casing cooling fluid reduces high voltage breakdown and provides cooling via natural or forced convection, for example.

The present embodiments, advantageously, by way of a turbulent flow, increase heat removal from the RF applicator 30 to maintain the temperature of the RF transmission line 33, for example, the outer conductor 31*b* at or below a desired temperature. Natural convection or laminar flow is advantageously used in, for example, the outermost concentric tubular conductor (annulus) to provide an additional layer of control of the temperature of an outer wall of an outermost concentric tubular conductor, to reduce total fluid recirculation to maintain acceptable assembly component temperatures.

A method aspect is directed to a method of processing hydrocarbon resources in a subterranean formation 21 using an apparatus 20 that includes a radio frequency (RF) source 22, a dielectric cooling liquid source 23, and an RF applicator 30 in the subterranean formation and coupled to the RF source to supply RF power to the hydrocarbon resources. The RF applicator 30 includes concentric tubular conductors 31*a*, 31*b* defining cooling passageways 32*a*, 32*b* therebetween coupled to the dielectric cooling fluid source 23.

The method includes generating a turbulent flow of the dielectric cooling liquid adjacent surfaces of the concentric tubular conductors 31*a*, 31*b* to thereby enhance thermal transfer. The turbulent flow may be generated to have a Reynolds number of greater than 2500, for example. To generate the turbulent flow, the variables that are used to determine the Reynolds number may be adjusted or configured. In particular, the method includes configuring at least one property of the dielectric cooling liquid, e.g., the viscosity and density. The properties of the dielectric cooling liquid may be chosen by choosing a dielectric cooling liquid with the desired properties. The method also includes configuring a flow rate of the dielectric cooling liquid. The flow rate may be configured by operation of the pump 26, for example. The turbulent flow is also generated by at least configuring the cooling passageways, for example, the diameters and cross-sectional areas of the concentric tubular conductors 31*a*, 31*b*. Where, for example, dielectric spacers 37' are used, the turbulent flow may further be generated by configuring the openings 22*a*'-22*d*' so that an inverse of the Graetz number is less than 0.05.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for processing hydrocarbon resources in a subterranean formation comprising:

a radio frequency (RF) source;

a dielectric cooling liquid source;

at least one other cooling fluid source;

an RF applicator in the subterranean formation and coupled to said RF source to supply RF power to the hydrocarbon resources, said RF applicator comprising a plurality of concentric tubular conductors defining a plurality of cooling passageways therebetween, the plurality of cooling passageways comprising first and second cooling passageways coupled to said dielectric cooling fluid source, and a third cooling passageway and a fourth cooling passageway coupled to said at least one other cooling fluid source;

at least one property of the dielectric cooling liquid, a flow rate of the dielectric cooling liquid, and a configuration of the cooling passageways operable together to generate a turbulent flow of the dielectric cooling liquid adjacent surfaces of said plurality of concentric tubular conductors to enhance thermal transfer.

2. The apparatus of claim 1, wherein the turbulent flow has a Reynolds number greater than 2500.

3. The apparatus of claim 1, further comprising a series of dielectric spacers between said plurality of concentric tubular conductors and having openings therein in fluid communication with the cooling liquid passageways.

4. The apparatus of claim 3, wherein said plurality of dielectric spacers defines a flow having an inverse Graetz number less than 0.05.

5. The apparatus of claim 1, wherein the at least one property of the dielectric cooling liquid comprises a density and a viscosity.

6. The apparatus of claim 1, wherein said dielectric cooling liquid source comprises:

a dielectric cooling liquid supply;

a heat exchanger; and a pump coupled to said dielectric cooling liquid supply and said heat exchanger.

7. The apparatus of claim 1, wherein the dielectric cooling liquid comprises mineral oil.

8. The apparatus of claim 1, wherein said plurality of tubular conductors extend laterally in the subterranean formation.

9. An apparatus for processing hydrocarbon resources in a subterranean formation comprising:

a radio frequency (RF) source;

a dielectric cooling liquid source;

a balun cooling fluid source;

a casing cooling fluid source;

an RF applicator in the subterranean formation and coupled to said RF source to supply RF power to the hydrocarbon resources, said RF applicator comprising an RF transmission line and an RF antenna coupled thereto, and a plurality of concentric tubular conductors defining a plurality of cooling passageways therebetween, the plurality of cooling passageways comprising first and second cooling passageways coupled to said dielectric cooling fluid source, a third cooling passageway coupled to said balun cooling fluid source, and a fourth cooling passageway coupled to said casing cooling fluid source; and a series of dielectric spacers between said plurality of concentric tubular conductors and having openings therein in fluid communication with the cooling liquid passageways;

at least one property of the dielectric cooling liquid, a flow rate of the dielectric cooling liquid, and a configuration of the cooling passageways operable together to generate a turbulent flow of the dielectric cooling liquid adjacent surfaces of said plurality of concentric tubular conductors to enhance thermal transfer.

10. The apparatus of claim 9, wherein the turbulent flow has a Reynolds number greater than 2500.

11. The apparatus of claim 9, wherein said plurality of dielectric spacers defines a flow having an inverse Graetz number less than 0.05.

12. The apparatus of claim 9, wherein the at least one property of the dielectric cooling liquid comprises a density and a viscosity.

13. The apparatus of claim 9, wherein said dielectric cooling liquid source comprises:

a dielectric cooling liquid supply;

a heat exchanger; and a pump coupled to said dielectric cooling liquid supply and said heat exchanger.

14. A method of processing hydrocarbon resources in a subterranean formation using an apparatus comprising a radio frequency (RF) source, a dielectric cooling liquid source, at least one other cooling fluid source, and an RF applicator in the subterranean formation and coupled to the RF source to supply RF power to the hydrocarbon resources, the RF applicator comprising a plurality of concentric tubular conductors defining a plurality of cooling passageways therebetween, the plurality of cooling passageways comprising first and second cooling passageways coupled to the dielectric cooling fluid source, and a third cooling passageway and a fourth cooling passageway coupled to the at least one other cooling fluid source, the method comprising:

passing the at least one other cooling fluid through the third and fourth cooling passageways, respectively; and generating a turbulent flow of the dielectric cooling liquid adjacent surfaces of the plurality of concentric tubular conductors to thereby enhance thermal transfer by at least configuring at least one property of the dielectric cooling liquid, configuring a flow rate of the dielectric cooling liquid, and configuring the first and second cooling passageways.

15. The method of claim 14, wherein generating the turbulent flow comprises generating a turbulent flow having a Reynolds number greater than 2500.

16. The method of claim 14, wherein the apparatus further comprise a series of dielectric spacers between the plurality of concentric tubular conductors and having openings therein in fluid communication with the cooling liquid passageways; and wherein generating the turbulent flow further comprises generating a turbulent flow defined by the openings having an inverse Graetz number less than 0.05.

17. The method of claim 14, wherein configuring the at least one property of the dielectric cooling liquid comprises configuring a density and a viscosity.

18. The method of claim 14, wherein configuring the flow rate of the dielectric cooling liquid comprises configuring the flow rate of mineral oil.

* * * * *